US006438351B2

(12) United States Patent
Kawachi et al.

(10) Patent No.: US 6,438,351 B2
(45) Date of Patent: Aug. 20, 2002

(54) IMAGE FORMING APPARATUS HAVING LOOP FORMING ROLLERS IN ACCORDANCE WITH RESPECTIVE SHEET FEED UNITS

(75) Inventors: Kunihiro Kawachi; Kyoichi Mizuno, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/748,697

(22) Filed: Dec. 26, 2000

(30) Foreign Application Priority Data

Jan. 6, 2000 (JP) ..... 2000-000670

(51) Int. Cl.[7] ..... G03G 15/00; B65H 3/06

(52) U.S. Cl. ..... 399/394; 271/9.01; 271/161; 399/390; 399/391; 399/401

(58) Field of Search ..... 399/394, 395, 399/396, 390, 391, 388, 401, 301, 43; 271/9.01, 161, 229, 242, 265.01, 265.02, 902

(56) References Cited

U.S. PATENT DOCUMENTS 3,957,366 A * 5/1976 Taylor et al. ..... 399/394
5,355,206 A * 10/1994 Maruyama et al. ..... 399/396
5,555,082 A * 9/1996 Tanaka et al. ..... 399/397
5,565,970 A * 10/1996 Suda ..... 271/9.01 X
5,729,819 A * 3/1998 Maekawa et al. ..... 399/401

* cited by examiner

*Primary Examiner*—Sophia S. Chen
(74) *Attorney, Agent, or Firm*—Bierman, Muserlian and Lucas

(57) ABSTRACT

An image forming apparatus includes a plurality of sheet feed units each for feeding a sheet, a single pair of registration rollers provided at the upstream side of the image formation site where an image is formed on the sheet with respect to the direction of sheet conveyance, for conveying the sheet in accordance with the timing of forming the image on the sheet, and a plurality pair of loop forming rollers provided in correspondence with the plurality of sheet feed units respectively at the upstream side of the pair of registration rollers with respect to the direction of sheet conveyance. Each of the plurality pair of loop forming rollers is controlled in a manner such that a loop is formed between each of the plurality pair of loop forming rollers and the pair of registration rollers.

6 Claims, 6 Drawing Sheets

IMAGE FORMING APPARATUS HAVING LOOP FORMING ROLLERS IN ACCORDANCE WITH RESPECTIVE SHEET FEED UNITS

BACKGROUND OF THE INVENTION

This invention relates to an image forming apparatus such as an electrophotographic copying machine or a printer.

In an image forming apparatus such as an electrophotographic copying machine or a printer, there is provided a sheet feed unit for containing paper sheets, and when an image is formed, a paper sheet is fed from the sheet feed unit, to form an image on the sheet.

FIG. 1 is a schematic drawing of a conventional image forming apparatus. In the drawing, the image forming apparatus 1 is equipped with the platen portion 2, the optical unit 3, the image forming means 4, the fixing unit 5, the sheet feed units 9*a* to 9*d*, reverse feed unit 9*e*, the manual sheet feed unit 9, the output tray 15. On the platen portion 2, it is placed an original document, of which an image is read through the optical unit 3, and the light of the read image is applied to the image carrying member 10 of the image forming means 4 to form a latent image, which is developed by the image forming means 4, to form a toner image. On the other hand, a paper sheet is conveyed out by the separation roller 140 from a sheet feed unit selected out of the sheet feed units 9*a* to 9*d* toward the conveyance rollers 132. The separation roller 140 has such a structure as not to rotate as long as a frictional force of a certain strength is not applied to it, and for example, if two sheets lying on each other are conveyed to the separation roller 140, the rotating force of the drive roller, which is placed opposite to the separation roller so as to press it, is not transmitted sufficiently to the separation roller 140, because the frictional force between the two sheets lying on each other is low. For this reason, the sheet in contact with the drive roller is conveyed, but the sheet in contact with the separation roller 140 is not conveyed because the separation roller does not rotate. The conveyance roller 132 conveys the paper sheet, which has been separated as a single sheet, to the loop forming rollers 134. The loop forming rollers 134 convey the sheet until the leading edge of the sheet hits the registration rollers 56 to form a loop, in order to correct the skew of the sheet. The registration rollers 56 start to rotate at a timing to make the sheet synchronized with the toner image on the image carrying member 10, and the toner image is transferred to the sheet. The paper sheet, having the toner image transferred, is conveyed to the fixing unit 5, in which the image is fixed, and is ejected onto the output tray 15.

In a conventional structure as described in the above, because loop formation is done by the conveyance of a paper sheet by the loop forming rollers 134 which are common to a plurality of sheet feed units, the amount of skew correction for a sheet is the same for every sheet feed unit.

However, the amount of skew of a sheet that is produced actually is different for each of the sheet feed units. As the cause of it, for example, the following can be thought of: the difference in the conveyance path length up to the loop forming rollers 134, the difference in the curvature of the conveyance path which is different depending on the position of the sheet feed units etc. For example, for the conveyance path from the sheet feed unit 9*a* arranged at the uppermost position to the loop forming roller 134, because of a small length of the path, the amount of skew component depending on the length of the path among the skew components produced by the friction between the sheet and the conveyance path can be suppressed comparatively to a low value, but the amount of skew component depending on the curvature of the path is comparatively large, because of the large curvature of the conveyance path. On the other hand, for the conveyance path from the sheet feed unit 9*d* arranged at the lowermost position to the loop forming roller 134, because of a large length of the path, the amount of skew component depending on the length of the path is comparatively large, but the amount of skew component depending on the curvature of the path can be suppressed comparatively to a low value, because of the small curvature of the conveyance path. However, in the case of a conventional apparatus, because it has a structure such that a loop is formed by the same loop forming rollers 134 in a sheet that is fed from any one of the sheet feed units 9*a* to 9*d*, the condition of the loop forming rollers 134 could not be set to an optimum one for each of the sheet feed units. Therefore, it has been the cause of lowering the reliability of sheet conveyance and the positional precision of the image on a sheet.

Further, in order to suppress the difference in the amount of skew of the sheet for each of the sheet feed units even to a small degree, it has been necessary to make the same the layout of the conveyance paths from the respective sheet feed units to the loop forming rollers 134. Accordingly, the degree of freedom in the design such as the arrangement of the conveyance paths in an image forming apparatus or the arrangement of the sheet feed units has been remarkably limited, which has been a cause to prevent an image forming apparatus from being made compact.

Further, because the roller 131 of the manual sheet feed unit 9 for manually feeding a sheet has a combined function of a separation roller for separating a sheet and a conveyance roller for conveying a sheet, its conveyance force is increased as compared to the separation roller of other sheet feed units. For this reason, the roller 131 of the manual sheet feed unit 9 has a structure different from the separation rollers, and that is a cause of the increase of the cost such as the designing cost and the material cost of the image forming apparatus.

Further, the roller for separating the sheets from the sheet feed unit is covered with a synthetic rubber, which is an elastic member, and the separation of sheets is performed by the frictional force between the elastic member and the sheet. Regarding the roller for separating sheets, in order to prevent that its capability of separation is lowered because of the deterioration of the frictional force of the elastic member by the change with the passage of time, it is necessary to periodically replace it with a new one.

FIG. 2 is a schematic drawing of a roller for separating a single sheet from others. For the replacement of the roller with a new one, it has been necessary that the rotary shaft 85 is dismounted from the main body of the image forming apparatus, and after that, the roller 86 covered with an elastic member is drawn out from the end of the rotary shaft 85, which necessitated a considerable time and labor.

SUMMARY OF THE INVENTION

It is an object of this invention to provide an image forming apparatus capable of making a correction for the skew of a sheet which is optimum for each of a plurality of sheet feed units.

The above-mentioned object is accomplished by any one of the following structures (1) to (6).

(1): An image forming apparatus including a plurality of sheet feed units for feeding a sheet, a single registration means provided at the upstream side of the image formation site where an image is formed on said sheet with respect to the direction of sheet conveyance, for conveying said sheet in accordance with the timing of forming the image on said sheet, and a plurality of loop forming means provided in correspondence with said plurality of sheet feed units respectively at the upstream side of said registration means with respect to said direction of sheet conveyance, wherein each of said plurality of loop forming means is controlled in a manner such that a loop is formed between itself and said single registration means.

(2): The image forming apparatus as set forth in the structure (1), further including a reversing mechanism for reversing said sheet upside down, said reversing mechanism having a reversing path capable of changing over the conveyance direction of said sheet to the reverse direction, wherein said sheet with its conveyance direction changed over by said reversing path is controlled in a manner such that a loop is formed between itself and said registration means by a loop forming means which is disposed closest to said reversing path among said plurality of loop forming means.

(3): The image forming apparatus as set forth in the structure (2), wherein the aforesaid reversing mechanism is provided in the main body of said image forming apparatus.

(4): The image forming apparatus as set forth in the structure (1), wherein each of the aforesaid plurality of sheet feed units includes a container portion for containing said sheet and conveying-out means for conveying out said sheet from said container portion, and each of said conveying out means provided in correspondence with each of said sheet feed units is provided at a position different from another with respect to a width direction of the image forming apparatus.

(5): The image forming apparatus as set forth in the structure (4), further including a reversing mechanism for reversing the aforesaid sheet upside down, wherein said reversing mechanism is disposed vertically in the side portion to the side of the aforesaid conveying-out means being disposed.

(6): The image forming apparatus as set forth in the structure (1), wherein the aforesaid plurality of loop forming means are set in a condition of different sheet gripping forces respectively in accordance with the conveyance paths from the respective loop forming means to the aforesaid registration means.

Further, desirable structures (7) to (10) are as follows.

(7) An image forming apparatus comprising a plurality of sheet feed units for feeding a sheet, a pair of registration rollers for carrying out the conveyance of a sheet in synchronism with the rotation of an image carrying member, and a plurality of pairs of loop forming rollers provided at the upstream side of said pair of registration rollers with respect to the direction of sheet conveyance for conveying a sheet by rotation, characterized by it, that said plurality of pairs of loop forming rollers are provided in correspondence with said plurality of sheet feed units, and convey a sheet until the leading edge of the sheet hits said pair of registration rollers to form a loop in the sheet before said pair of registration rollers start to rotate.

(8) The image forming apparatus as set forth in the paragraph (7), further comprising a reversing path in which the first surface and the second surface, that is, the front side and the rear side, of a sheet characterized by it, that the formation of a loop of a sheet to be subjected to an image formation on the second surface after an image has been formed on its first surface is carried out by a pair of loop forming rollers corresponding to the sheet feed unit disposed closest to said reversing path.

(9) An image forming apparatus comprising a pair of rollers having a structure such that a drive roller and a driven roller is pressed into contact by an urging member, and a sheet is conveyed by the rotation of said drive roller, characterized by it, that a brake member for limiting the rotation of said driven roller and said driven roller are built integrally and are made capable of being mounted to and dismounted from the main body of the apparatus through an elastic member having resilient force.

(10) The image forming apparatus as set forth in the paragraph (9) characterized by it, that the aforesaid driven roller is a separation roller for separating a single sheet from others.

DETAILED DESCRIPTION OF THE PREFERRED EMBODIMENT

In the following, an example of the embodiment according to this invention will be explained on the basis of the drawings.

Figure 3:
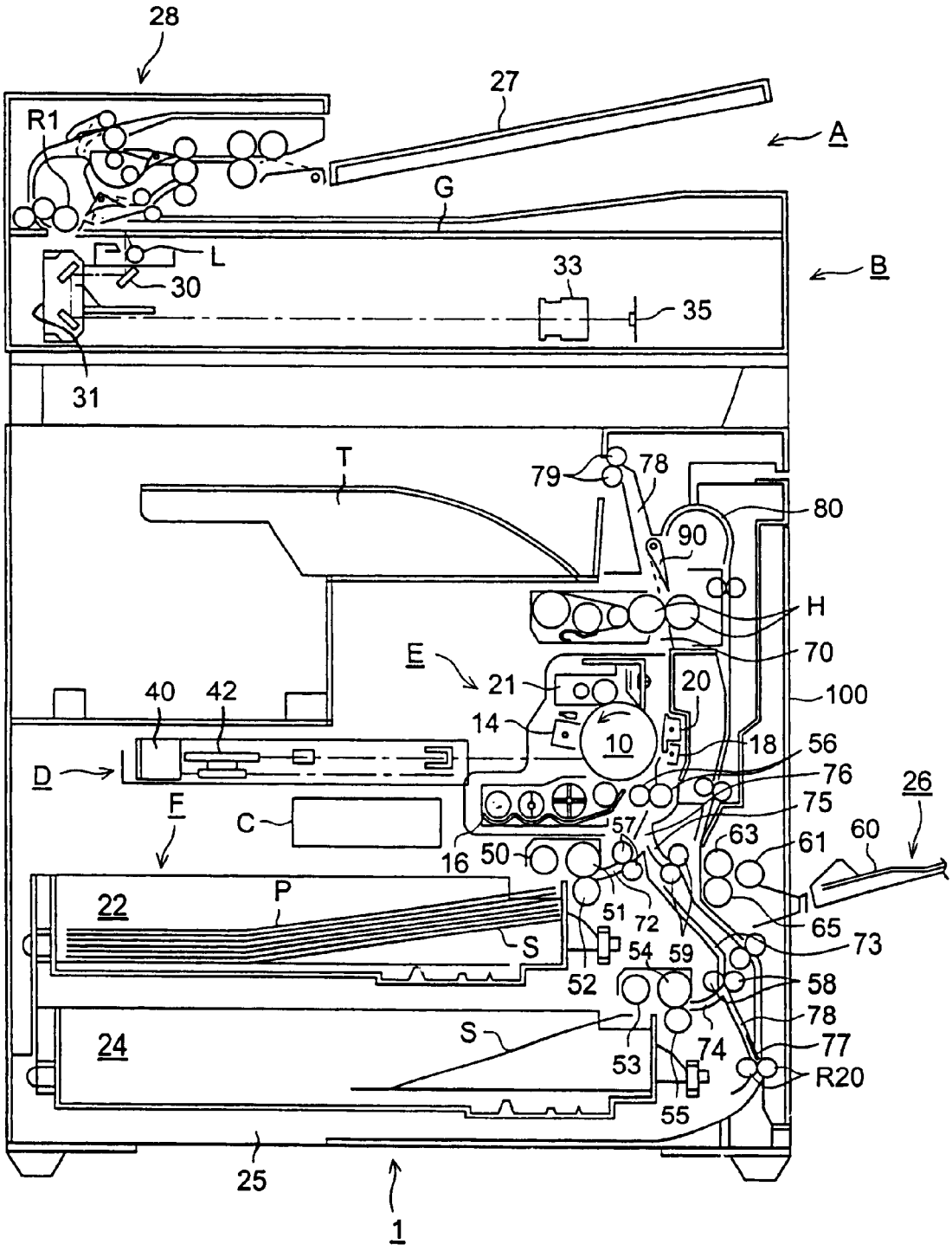
FIG. 3 is a schematic drawing showing the structure of an image forming apparatus.

FIG. 3 is a schematic drawing showing the structure of the image forming apparatus 1. In the drawing, the image forming apparatus 1 includes the automatic document feeder (usually called an ADF) A, the original image reading section B for reading the image of an original document conveyed by the automatic document feeder, the image processing means C for encoding the read image of the original document and processing the data, the writing section D for carrying out writing on the image carrying member 10 made up of a photoreceptor drum 10 on the basis of the image data after image processing, the image forming section E including the image forming means such as the image carrying member 10, the charging electrode 14 in the neighborhood of its peripheral surface, the developing means 16 composed of a developing unit of a magnetic brush type, the transfer electrode 18, the detachment electrode 20, the cleaning means 21, and sheet feeding section F includes the sheet feed units 22 and 24 containing the paper sheet for image formation (hereinafter simply referred to as the sheet) P.

The automatic document feeder A has the document setting base 27 and the document feed processing portion 28 including the group of rollers including the roller R1 and the switching-over means (no reference sign attached) for suitably switching over the moving path of the document. The document image reading section B is provided under the top glass plate G, and is composed of the two mirror units 30 and 31 capable of moving back and forth with the optical path length kept constant, the fixed image forming lens 33, the image sensor 35, etc.; the writing section D is composed of the laser light source 40, the polygonal mirror 42, etc. Further, the pair of rollers shown at the upstream side of the transfer electrode 18 with respect to the conveyance direction of the sheet P are the registration rollers 56, and the unit denoted by H at the downstream side of the detaching electrode 20 is the fixing means. In the embodiment, the fixing means H are provided with the roller containing a heating source inside, and the pressing roller which rotates as being pressed in contact with said roller.

A sheet of the document (not shown in the drawing) set on the document setting base 27 is conveyed in the document feed processing portion 28, and while it passes under the roller R1, the light from the light source L is reflected by its surface and forms an image on the image sensor 35 through the mirror units 30 and 31 at the fixed positions and the lens 33, to be read by the sensor. The image information of the read document is processed by the image processing means C, and the encoded data of the image information are stored in a memory. The data of the image information stored in the memory are read out in response to the instruction at the time of image formation, and the laser light source 40 in the writing section D is driven in accordance with the data, to apply the laser beam to the image carrying member 10 for exposure. Preceding the exposure, the image carrying member 10 is charged to a predetermined surface potential by the corona discharging action of the charging electrode 14; owing to the exposure by the laser beam, the electric potential at the exposed area is decreased in accordance with the exposure amount, and as the result of it, an electrostatic latent image is formed on the image carrying member 10 corresponding to the image data. The electrostatic latent image is developed reversely by the developing means 16, and becomes a visible image (toner image).

On the other hand, the sign S' in the sheet feed unit 22 denotes the movable plate of which the free end is always urged in the upward direction by an urging means such as a coil spring (not shown in the drawing), the topmost sheet P is brought into contact with the conveying-out roller 50. The sheet P, which has been brought into contact with the conveying-out roller 50, is conveyed out from the sheet feed unit 22 to the pair of rotatable rollers, namely, the drive roller 51 and the driven roller 52. The drive roller 51 rotates and conveys the single sheet P to the loop forming rollers 57 by the action of the driven roller 52 as a separation roller for separating a single sheet from others.

The loop forming rollers 57 is provided at the upstream side of the registration rollers 56 with respect to the sheet conveying direction, and its rotation makes the conveyance of the sheet p to form a loop of the sheet P by bringing the leading edge of the sheet P into contact with the registration rollers 56 before the start of rotation. By the formation of a loop, the leading edge of the sheet P is adjusted and the skew of the sheet P is corrected. After that, the registration rollers 56 starts to rotate in synchronism with the rotation of the image carrying member 10, to convey the sheet P. The toner image on the image carrying member 10 and the sheet P, which has been conveyed in synchronism, are brought into the superposed state, and the toner image is transferred to the sheet P by the actuation of the transfer electrode 18. After the sheet P has been detached from the image forming member 10 by the actuation of the detaching electrode 20, sheet P passes through area 70 and then the toner particles forming the toner image are fused and fixed on the sheet P by the pressing and heating of the fixing means H, and the sheet P is ejected onto the output tray T through the sheet ejecting path 78 and the ejecting roller 79.

The conveyance of a sheet from the sheet feed unit 24 is carried out by the following rollers, namely, the conveying-out roller 53, the drive roller 54 and the driven roller 55 forming a roller pair, through the conveyor path 74, and the loop forming roller 58, through the conveyance path 73 to the registration rollers 56 which are common to the plural sheet feed units.

The manual sheet feed unit 26 is provided with the manual feed tray 60 for setting a sheet, and has such a structure as to be capable of opening and closing, being supported at the lower end against the side wall of the main body of the image forming apparatus 1. The conveyance of a sheet from the manual sheet feed unit 26 is carried out, in the similar way to the above-mentioned sheet feed unit 24, by the following rollers, namely, the conveying-out roller 61, the drive roller 63 and the driven roller 65 forming a roller pair, and the loop forming roller 59, through the conveyance path 75 to the common registration rollers 56. Accordingly, the formation of a loop of the sheet P is carried out by the conveyance of the sheet P by each of the plural loop forming rollers 57, 58, and 59 which are provided in correspondence with the respective sheet feed units.

Further, in the embodiment, the sheet feed unit 22 and the sheet feed unit 24 are arranged in a two-stage manner in the up-and-down direction, but more number of sheet feed units also can be provided.

In the case where the apparatus is set in a mode in which image formation is carried out on the both sides of the sheet P, the bifurcating guide 90 is controlled by the control section (not shown in the drawing) in such a way that it takes the position shown by the broken line in the drawing in order that the sheet P, to which a toner image has been transferred on the first side in the image formation process, is fed into the conveyance path 80, and takes the position shown by the solid line after the sheet is fed into the conveyance path 80. The conveyance path 80 is formed in a shape of a gentle circular arc to secure a smooth movement of the sheet P. The sheet P, which has passed the conveyance path 80 and moved downward, crosses the sheet conveyance path from the manual sheet feed unit 26, and reaches the rollers R20 for switchback. The rollers R20 for switchback is formed of a pair of rollers capable of reversible rotation and makes the sheet P proceed to the reversing path 25 having a specified space between the base portion (having the same meaning as the base wall) of the sheet feed tray 24 provided at the downside of the rollers R20 for switchback and the base wall of the main body of the apparatus. The leading edge of the sheet P having reached the rollers R20 for switchback is gripped by the rollers and guided to the reversing path 25 by their rotation. At this time, the image transferred on the sheet P faces down. Some time later, the rollers R20 for switchback stops rotating with the trailing edge of the sheet P gripped between them. After that, when they start rotating, the sheet P is fed into the conveyance path 78 with bifurcation guide 77 in the position shown in FIG. 3 and sheet P is fed with its upside reversed down by the reversing path 25, that is, with the second side having no image transferred made to face toward the imaged carrying member 10. The sheet P having been fed into the conveyance path 78 is conveyed to the loop forming rollers 58 provided in correspondence with the sheet feed unit 24 which is nearest to the reversing path 25. The loop forming rollers 58 convey the sheet P through the conveyance path 73, which is the same for the sheet conveyed out from the sheet feed unit 24, and make the leading edge of the sheet P hit the registration rollers 56 before the start of rotation to carry out the formation of a loop. The formation of a loop of the sheet P, of which on the first side an image has already been formed, and an image is to be formed on the second side, is carried out by the pair of loop forming rollers corresponding to the sheet feed unit which is nearest to the reversing path 25; therefore, a correction which is closest to the amount of skew of the conveyed sheet P can be done.

On the other hand, the second toner image has been formed on the image carrying member 10, and the registration rollers 56 start rotating in synchronism with the rotation of the image carrying member 10, to convey the sheet P having formed a loop. The toner image on the image carrying member 10 is brought into the state of exactly superposing the second side of the sheet P conveyed in synchronism with it, and the toner image is transferred to the sheet P by the actuation of the transfer electrode 18. After that, fixing processing is carried out, and the sheet P enters the sheet ejection path 78, to be ejected onto the output tray T through the ejection roller 79.

In the following, an example of formation of a loop of a sheet according to this invention will be explained on the basis of the drawings.

Figure 4:
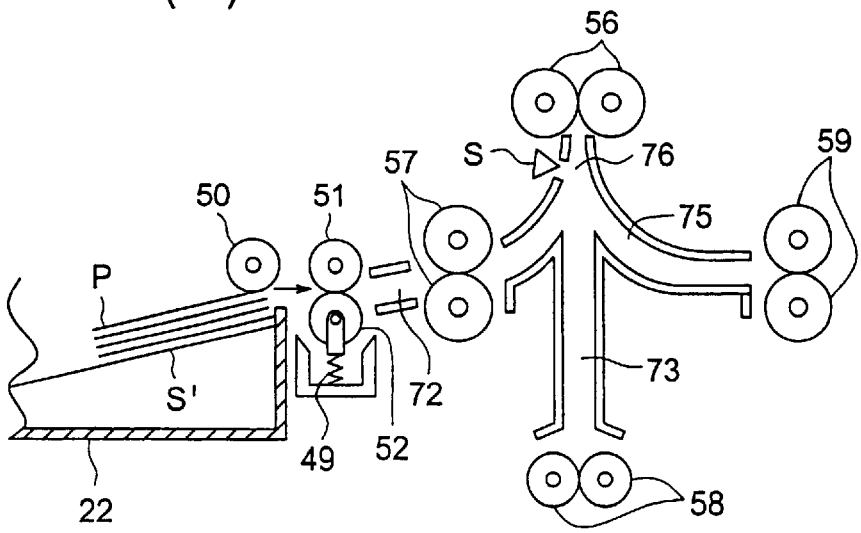
FIG. 4(*a*) to FIG. 4(*c*) are schematic drawings of a pair of rollers for conveying the sheet P to form a loop.
Figure 4:
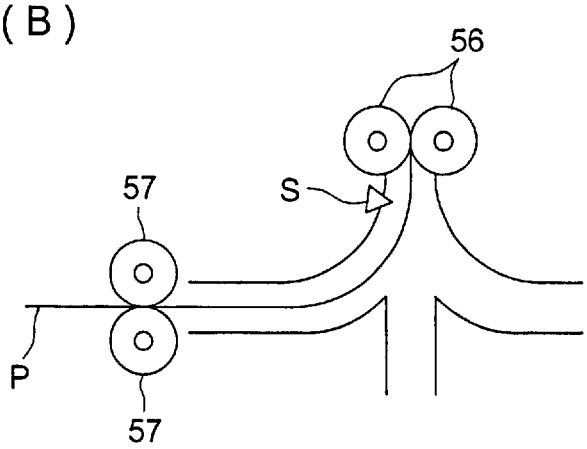
Figure 4:
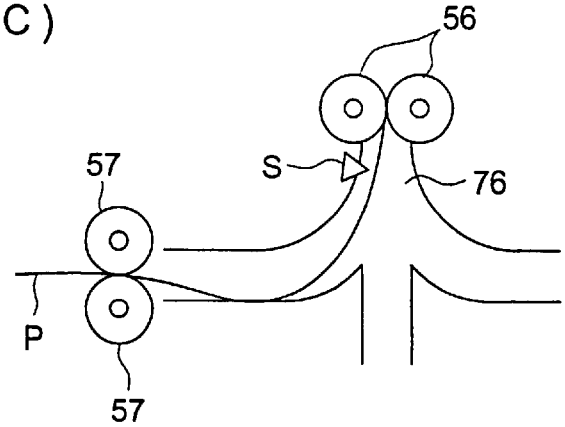

FIG. 4(*a*) to FIG. 4(*c*) are schematic drawings of rollers for conveying the sheet P to form a loop; FIG. 4(*a*) shows the plural pairs of loop forming rollers provided respectively in correspondence with the plural sheet feed units, FIG. 4(*b*) shows the situation in which the leading edge of the sheet P having been conveyed out from the sheet feed unit 22 come to contact with the registration rollers 56, and FIG. 4(*c*) shows the situation in which the sheet P has formed a loop by being conveyed. In the drawings, the sheet P contained in the sheet feed unit 22 is brought into contact with the conveying-out roller 50, and is conveyed out from the sheet feed unit 22 to the rotatable pair of rollers, namely, the drive roller 51 and the driven roller 52. The drive roller 51 is rotated by the driving force transmitted from a drive source (not shown in the drawing), to convey the sheet P. The driven roller 52 is provided with a braking member made up of a torque limiter for limiting the torque within a specified value for the rotation, and is pressed into contact with the drive roller 51 by the urging member 49 made up of a spring member. For example, when two sheets of P attaching to each other for some reason are conveyed from the conveying-out roller 50, one of the sheets P, which is in contact with the drive roller 51, is conveyed toward the conveyance path 72 by the frictional force resulting from rotation, but for the sheet P, which is in contact with the driven roller 52, the frictional force of the drive roller 51 is not sufficiently transmitted to the driven roller 52, because the coefficient of friction between the two sheets superposing each other is small. The driven roller 52 is provided with a torque limiter as a brake member for limiting the rotation of the driven roller, and does not rotate as long as the brake force of the brake member for limiting the rotation of the driven roller exceeds the transmitted frictional force which is lowered by the superposing of the two sheets. For this reason, the sheet in contact with the driven roller 52 is not conveyed, and only the sheet P in contact with the drive roller 51 is conveyed. In the case where a single sheet P is conveyed out from the conveying-out roller 50, the frictional force from the drive roller 51 is transmitted through the sheet P to the driven roller 52; therefore, the transmitted frictional force exceeds the brake force, and the driven roller 52 rotates to convey the sheet P while giving a tension of certain strength to the sheet P. That is, because the brake force applied by the torque limiter of the driven roller 52 for the rotation is determined to a value which is larger than the frictional force between two sheets and is smaller than the frictional force between the sheet and the drive roller 51 or a frictional force between the sheet and the driven roller 52, the function as a separation roller for separating a single sheet from others works, to prevent the double feed of sheets. When the sheet P is gripped by the loop forming rollers 57 after the specified rotation of the conveying-out roller 50 and the drive roller 51, the driving force is intercepted, and they become free rollers.

The control circuit (not shown in the drawing) controls the drive for the rotation of the loop forming rollers 57, and makes the sheet P conveyed to the registration rollers 56. The sensor S detects the leading edge of the conveyed sheet P, and transmits a detection signal to the control circuit. The control circuit makes a judgment that the leading edge of the sheet P hits the registration rollers 56 after the time T1 from the timing when the sensor made the detection. After that, the loop forming rollers 57 rotate from the timing of hitting to a specified timing determined beforehand, to convey the sheet P. The leading edge of the sheet P is regulated by the non-rotating registration rollers 56, and the formation of a loop of the sheet P is carried out up to a specified timing determined beforehand. The skew of the sheet P is corrected in accordance with the amount of the formed loop, and the registration rollers 56 convey the sheet P quickly in synchronism with the rotation of the image carrying member 10, utilizing the stiffness of the loop formed. The above-mentioned formation of a loop has been explained using the loop forming rollers 57 which are a pair of conveyance members corresponding to the sheet feed unit 22; however, the formation of a loop by the loop forming rollers 58 corresponding to the sheet feed unit 24 and that by the loop forming rollers 59 corresponding to the manual sheet feed unit 26 are carried out in substantially the same manner as the above in order to achieve the same function.

That is, because the formation of a loop by means of any one of the pairs of loop forming rollers provided respectively in correspondence with the plural sheet feed units is the correction of skew made in accordance with the sheet feed unit, it is carried out by conveying the sheet for the specified time period. Therefore, the control circuit need not control each of the pairs of loop forming rollers for forming a loop, which lightens the load of the control circuit for the operation processing. Further, in the case where some sheet feed units are additionally provided, it is necessary only to provide pairs of loop forming rollers in accordance with the number of sheet feed units provided additionally.

Figure 5:
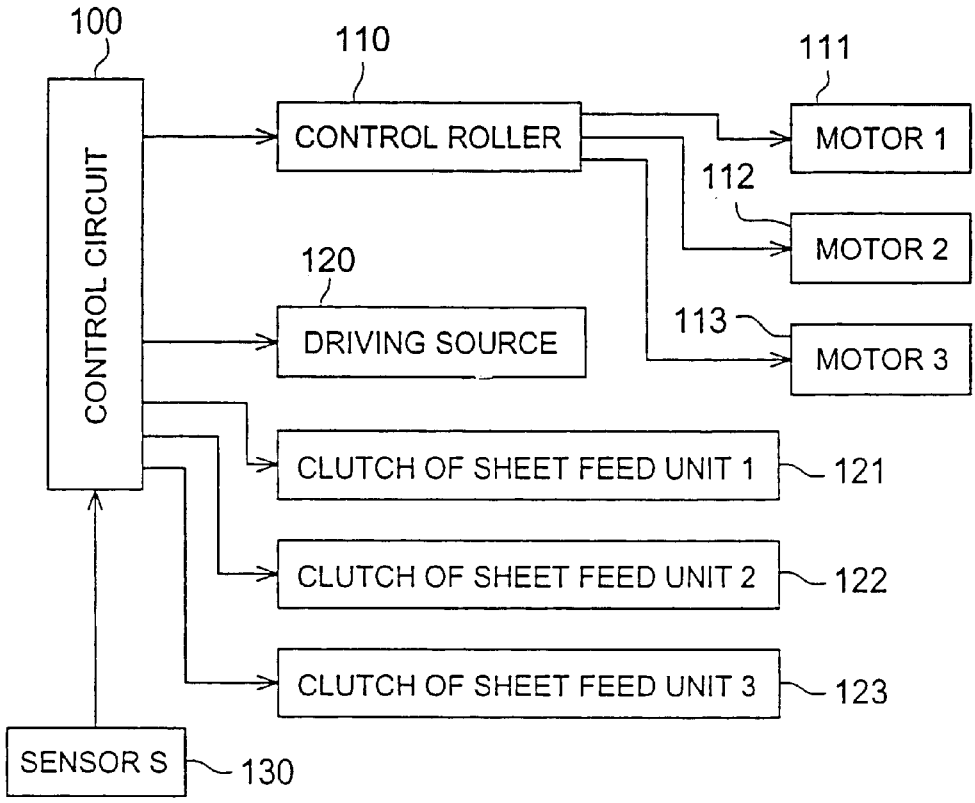
FIG. 5 is a block diagram of a control circuit for forming a loop of a sheet.

FIG. 5 is a block diagram of the control circuit for forming a loop of a sheet. When the image forming apparatus carries out image formation by selecting one out of plural sheet feed units, the control circuit 100 transmits a control signal to the drive source 120 for making the conveying-out roller and the drive roller rotate, and transmits a connection signal to an electromagnetic clutch corresponding to the selected sheet feed unit out of the electromagnetic clutches 121 to 123. To the conveying-out roller and the drive roller of the sheet feed unit to which the electromagnetic clutch is connected by the connection signal, the rotating force of the drive source 120 is transmitted, to rotate the rollers for conveying out. After that, the control circuit 100 transmits a selection signal for the selected sheet feed unit to the controller 110. The controller 110 transmits a drive signal to the motor for rotating the pair of loop forming rollers corresponding to the selected sheet feed unit among the motors 111 to 113. The corresponding motor is driven by the drive signal, to rotate the pair of loop forming rollers to convey a sheet toward the registration rollers 56. When the sensor 130 detects the leading edge of the sheet, the control circuit makes a judgment that the sheet will hit the pair of registration rollers after the time T1 from the timing of the detection, and transmits a detection signal to the controller 110. The controller 110 makes the motor stop which is rotating the pair of loop forming rollers after the specified time T2 determined beforehand for the selected motor. The specified time T2 is the time for the sheet conveyance for forming a loop which is predetermined depending on the length of the sheet conveyance path from each of the sheet feed units, and corresponds to the amount of correction of skew of the sheet. Further, because the precision of the sheet conveyance by the motor influences the precision of the correction of skew, a stepping motor having a high precision of conveyance is desirable for the motor.

Figure 6:
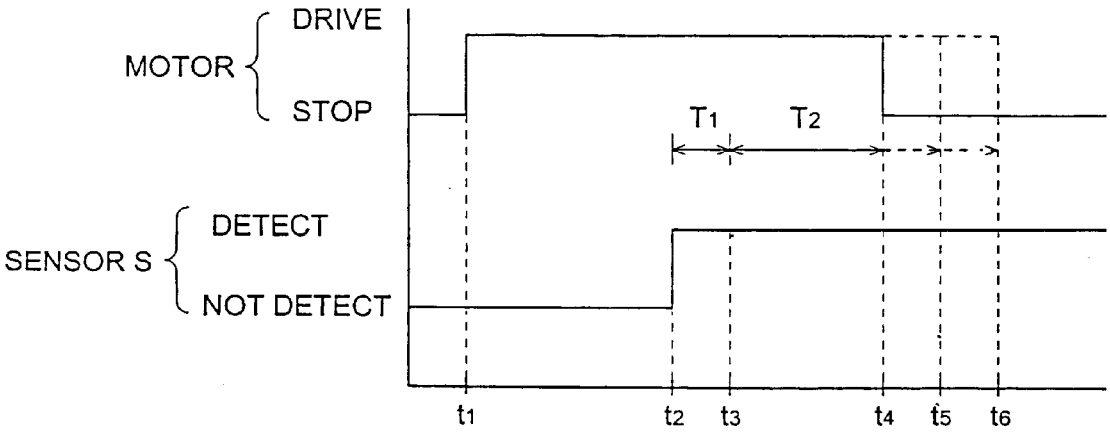
FIG. 6 is a timing chart of the motor for rotating a pair of loop forming rollers when a loop of the sheet P is formed and the sensor S.

FIG. 6 shows the timing chart of the motor for rotating the loop forming rollers when a loop of the sheet P is formed and the sensor S for detecting the leading edge of the sheet. In the drawing, t1 denotes the timing when a sheet is conveyed out from the sheet feed unit at the time of the image formation by the image forming apparatus, t2 denotes the timing when the sensor S detects the leading edge of the sheet, and t3 denotes the timing when the leading edge of the sheet hits the registration rollers 56. The specified time period T2 for the sheet to form a loop is determined by the length of the conveyance path from the sheet feed unit, and the size and kind of the sheets contained in the sheet feed unit. For example, t4 denotes the timing for the sheet feed unit 22 from which the conveyance path is shortest, t5 denotes the timing for manual sheet feed unit 26 for feeding a thick paper sheet, and t6 denotes the timing for the sheet feed unit 24 from which the conveyance path is longest.

Further, it will be explained in the following, the replacement of the driven roller as the separation roller having its function to prevent the double feed of sheets lowered by the weakened frictional force owing to the deterioration of the rubber.

Figure 1:
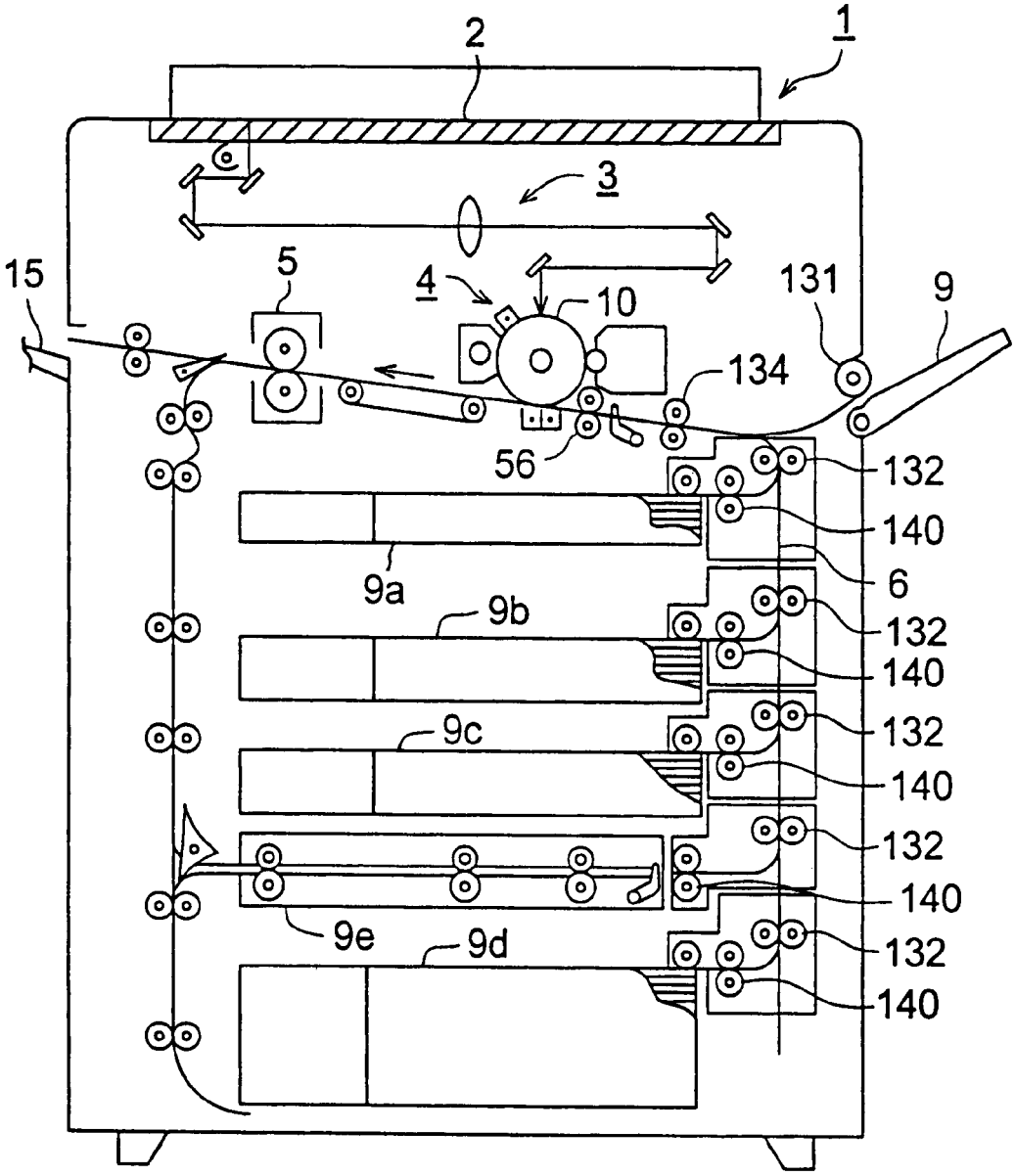
FIG. 1 PRIOR ART
FIG. 1 is a schematic drawing of a conventional image forming apparatus.
Figure 2:
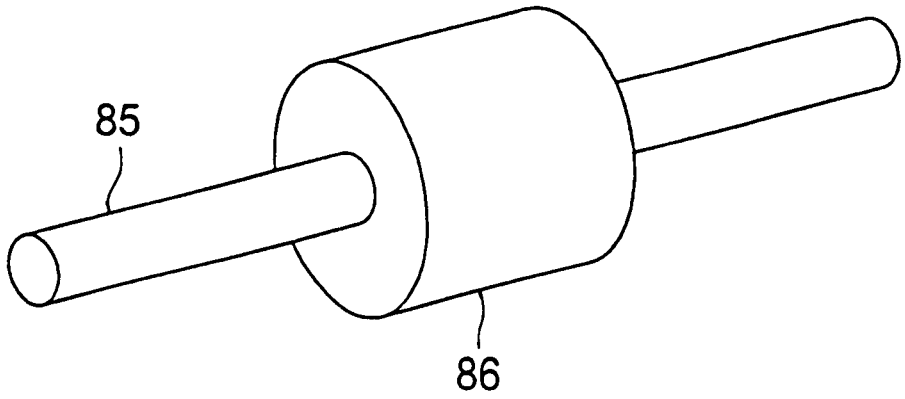
FIG. 2 PRIOR ART
FIG. 2 is a schematic drawing of a roller for separating a single sheet from others.
Figure 7:
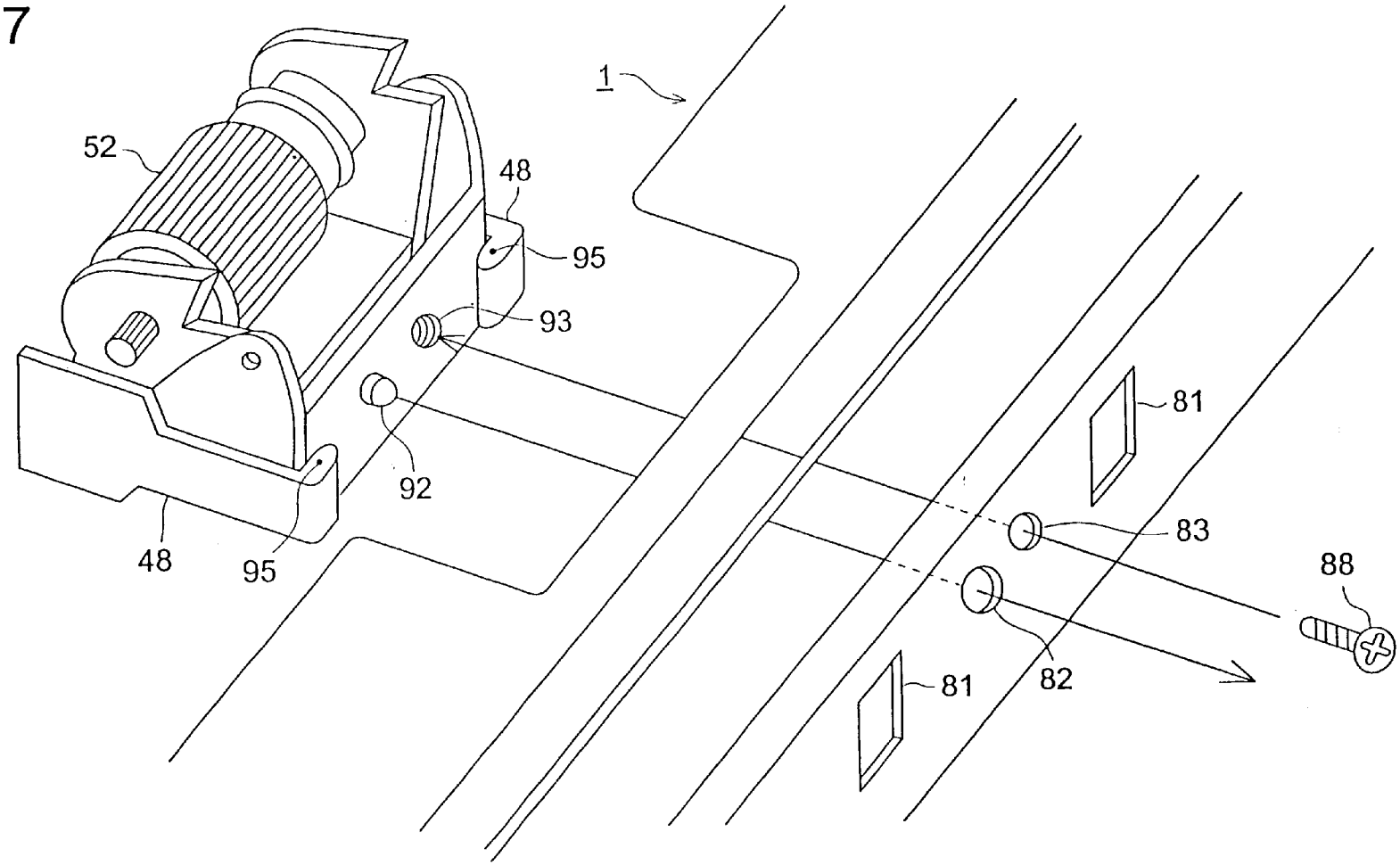
FIG. 7 is a schematic drawing of a driven roller capable of being mounted and dismounted through an elastic member shown in FIG. 1 and FIG. 4(*a*) to FIG. 4(*c*).

FIG. 7 is a schematic drawing of a driven roller capable of being mounted to and dismounted from the main body of the apparatus through the elastic member shown in FIG. 1 and FIG. 4(*a*) to FIG. 4(*c*). In the drawing, the driven roller 52 provided with a torque limiter as a brake member for limiting its rotation is integrated with the elastic members 48 having resilient force provided at the both ends of the driven roller 52, the boss 92, and the screw hole 93. The boss 92 is fitted in the positioning hole 82 of the image forming apparatus 1 for regulating the mounting position of the roller. At the same time, the claw portion 95 of the elastic member 48 is inserted through the opening 81 of the image forming apparatus 1, with the resilient force made to act toward inside, and the integrally built driven roller 52 is mounted to the image forming apparatus 1. After that, the screw 88 is fitted through hole 83 to the screw hole 93, to fix the driven roller 52 to the image forming apparatus 1. If an operator carries out the operation of, for example, screwing-on or screwing-off as pressing the driven roller 52, he must use his both hands, but by carrying out the mounting or dismounting operation through the elastic member 48, he can do the operation of screwing-on and screwing-off with one hand. Accordingly, a reliable replacement operation of the driven roller 52 can be made.

As explained in the foregoing, according to this invention, because a plurality of pairs of loop forming rollers are arranged respectively in correspondence with the plural sheet feed units, it is possible to make an optimum control of the loop forming for each of the conveyance paths from the respective sheet feed units to the registration rollers. Therefore, the reliability of conveyance can be raised and also the positional precision of an image on a sheet can be raised. Further, because the degree of freedom in the layout of the conveyance paths is broadened, the degree of freedom in the layout of the sheet feed units is also broadened, and it becomes possible to make the image forming apparatus compact. Furthermore, because the degree of freedom in the layout of the conveyance paths and the sheet feed units is broadened, even in the case where it is made a design such that a sheet reversing mechanism for the duplex image formation or the like is provided in the image forming apparatus, the degree of freedom in the design is broadened, and it becomes possible to make the apparatus compact. Moreover, for a sheet of which the direction of conveyance is switched over to the reverse direction in the reversing path of the sheet reversing mechanism, by the structure such that a loop is formed by the pair of loop forming rollers disposed at the nearest position to the reversing path, it is made unnecessary to provide a loop forming roller to be exclusively used for the reversed sheet, and on top of it, for the skew of the sheet depending on the conveyance path from the reversing path to the registration rollers, a condition which is closest to the optimum value of the correction condition can be obtained.

Further, because the driven roller provided with a torque limiter is made capable of easily being mounted and dismounted, the operation of replacing the roller for maintenance etc. can be reliably carried out, which lightens the load of the operation.

What is claimed is:

1. An image forming apparatus comprising:

(a) a plurality of sheet feeding units each for feeding a sheet, each of the sheet feeding units comprising a conveying out roller for feeding the sheet from a sheet cassette, a drive roller, and a driven roller in contact with the drive roller for feeding the sheet fed by the conveying out roller;

(b) a single registration means for conveying the sheet in synchronization with a timing of forming an image on the sheet;

(c) a plurality of loop forming means each provided on an upstream side in a sheet conveyance direction with respect to the single registration means in accordance with each of the plurality of sheet feeding units, the plurality of loop forming means being positioned downstream of each of the sheet feeding units; and (d) a controller for controlling each of the plurality of loop forming means to form a loop of the sheet between the single registration means and each of the plurality of loop forming means.

2. The image forming apparatus of claim 1 further comprising a reversing mechanism for turning the sheet upside down which has a reversing path for switching the sheet conveyance direction over to an opposite direction, wherein the sheet which has been switched in the opposite direction at the reversing path, is controlled to form a loop between the single registration means and a loop forming means by said loop forming means that is disposed closest to the reversing path among the plurality of loop forming means.

3. The image forming apparatus of claim 2, wherein the reversing mechanism is disposed in a main body of the image forming apparatus.

4. The image forming apparatus of claim 1, wherein each of the plurality of sheet feeding units has an accommodating section for accommodating sheets and a sheet feeding means for feeding a sheet one by one, wherein the sheet feeding means provided in accordance with each of the plurality of sheet feeding units is provided in a position different from one another with respect to a width direction of the image forming apparatus.

5. The image forming apparatus of claim 4 further comprising a reversing mechanism for turning the sheet upside down which is disposed vertically in a side portion of a side on which each of the plurality of sheet feeding means is disposed.

6. The image forming apparatus of claim 1, wherein each of the plurality of loop forming means is set in a condition of sheet gripping force different from one another in accordance with each of conveyance paths from the loop forming means to the single registration means.

* * * * *